United States Patent [19]

Inagawa et al.

[11] 4,060,782

[45] Nov. 29, 1977

[54] INTEGRATED TYPE SWITCHING DEVICE

[75] Inventors: Takashi Inagawa; Sadayuki Mitsuhashi, both of Tokyo, Japan

[73] Assignee: Nippon Electric Company, Limited, Tokyo, Japan

[21] Appl. No.: 659,432

[22] Filed: Feb. 19, 1976

[30] Foreign Application Priority Data

Feb. 19, 1975 Japan ..... 50-19901

[51] Int. Cl.[2] ..... H01H 67/24

[52] U.S. Cl. ..... 335/112; 335/196

[58] Field of Search ..... 335/112, 196; 200/175, 200/178; 340/166 S

[56] References Cited

U.S. PATENT DOCUMENTS 3,838,239 9/1974 Maruscak et al. ..... 200/175

3,962,659 6/1976 Ken-Irhiro et al. ..... 335/196

*Primary Examiner*—Harold Broome

*Attorney, Agent, or Firm*—Sughrue, Rothwell, Mion, Zinn and Macpeak

[57] ABSTRACT

A switching device is provided which is of a highly integrated structure and particularly adapted for a matrix arrangement of switch elements. The structure characteristically enables the switching device to be efficiently fabricated with maximum component density and minimum cost, and includes a base plate in the form of an integral combination of two insulating plates lying on each other, fixed contacts formed in an appropriate pattern on one of the insulating plates, and movable contacts formed integrally with spring strips supported on the base plate.

9 Claims, 8 Drawing Figures

INTEGRATED TYPE SWITCHING DEVICE

BACKGROUND OF THE INVENTION

This invention relates to switching devices of the type including a plurality of switch elements selectively operable under the control of electromagnetic or other drive means and is primarily intended to provide a switching device of the type concerned which is highly integrated in structure for maximum component density.

In U.S. Pat. No. 3,150,244, issued Sept. 22, 1964, to Rudolf Nitsch et al., there is disclosed an electromagnetic relay device which includes a metallic carrier or base plate in which a number of core members are inserted perpendicularly to the plane of the base plate and tightly secured therein by glass seal means for operative association with the respective relay elements. Provided on the metallic base plate is a cover member which is hermetically secured to the plate to define a sealed chamber thereon and to the inside of which a spring strip is welded to support movable contacts in the sealed chamber.

With such known structure, however, since the cover is designed also to serve as a signal line common to the movable contacts, it is very difficult to form a matrix switching device in which switch elements are arranged in a matrix and the movable contacts thereof are electrically connected in series with each other, for example, in each of the columns or rows of the matrix so that the columns or rows of movable contacts may be utilized independently from each other.

Again, with the known structure, in which the base plate is metallic and the cores themselves serve as electrical conductors forming part of the signal lines, wiring connection of the signal lines and core energizing windings or coils cannot be made on the base plate necessitating use of some additional means such as a printed circuit board outside of the structure itself. This results in an increase in number of component parts as well as in cost fabrication and thus the use of such structure inadvisable for realization of any high density integrated matrix switching device.

Moreover, the known relay structure, in which core members are inserted in a metallic base plate and fixed in place by glass seal means necessitates a considerably complicated process of fabrication which includes glass sealing of the core members, involving the danger that the magnetic quality of the core members may become deteriorated at the elevated temperatures employed.

SUMMARY OF THE INVENTION

In view of the above, the present invention has for its object the provision of an integrated switching device which is of a compact, space saving structure and includes a base plate of insulating material on which a multitude of switch elements are assembled.

Another object of the present invention is to provide a matrix switching device of the character described which is particularly designed for ease of fabrication and maximum component density.

According to the present invention, there is provided an integrated switching device which comprises a first plate of insulating material having a plurality of fixed contacts arranged on one surface thereof, a second plate of insulating material formed with through apertures in positions corresponding to the respective fixed contacts arranged on the first insulating plate, the first and second insulating plates being laid on each other in closely adhering relation to form an integral base plate for the switching device, spring means carrying movable contacts and mounted on the base plate so that the movable contacts are positioned directly opposite to the respective fixed contacts for cooperation therewith, and drive means electrically or magnetically operable to selectively drive the movable contacts in an axial direction of the apertures into contact with the corresponding fixed contacts.

Further, according to the present invention, there is provided an integrated switching device of the character described in which the through apertures and associated fixed and movable contacts are arranged in a matrix array and the spring means are formed in common for each of the columns or rows of matrix to connect the movable contacts with each other in each column or row of the matrix and which further comprises conductor means sandwiched between the first and second insulating plates to connect the fixed contacts with each other in each of the rows or columns of the matrix.

BRIEF DESCRIPTION OF THE DRAWINGS

The above and other objects, features and advantages of the present invention will become apparent from the following description taken in conjunction with the accompanying drawings, in which.

DESCRIPTION OF THE PREFERRED EMBODIMENT

Figure 1:
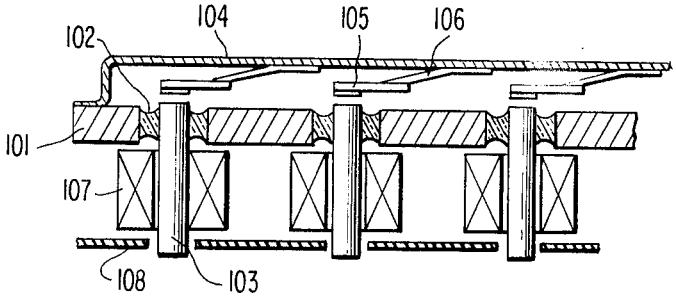
FIG. 1 PRIOR ART
FIG. 1 is a fragmentary cross-sectional view illustrating a conventional form of multiple element type electromagnetic switching device.

Referring to the drawings and first to FIG. 1, which illustrates a conventional form of multiple element type electromagnetic switching device, reference numeral 101 indicates a carrier or base plate of nonmagnetic metal in which core members 103 are each inserted and secured in place by glass seal means 102 perpendicularly to the plane of the base plate. Mounted on the base plate 101 is a cover 104 which is hermetically sealed thereto by welding through the medium of a flange formed on the cover along the periphery thereof, as shown, to define a sealed chamber in cooperation with the base plate. Welded to the inside of the cover 104 are spring strips 106 each of which supports a relay armature 105. An energizing winding or coil 107 is fitted to each of the core members 103 in encircling relation to the downwardly extending portion thereof. The core members 103 are inserted at their free ends into an electrically insulating plate 108 and electrically connected in an appropriate manner to electrical circuit means, for example, formed thereon.

Figure 2:
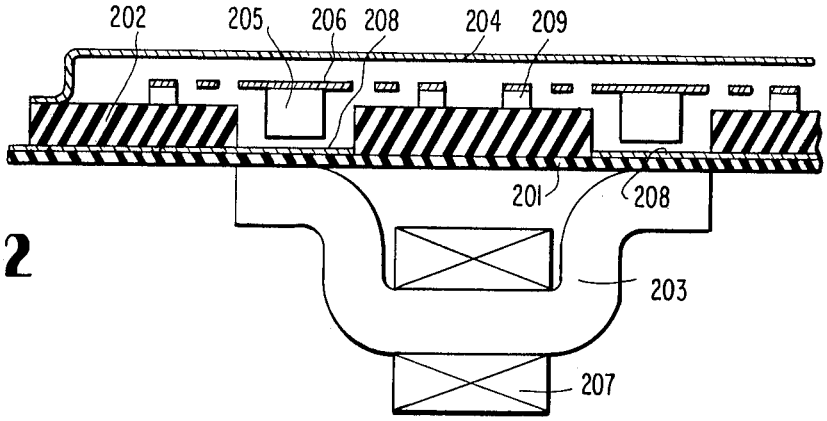
FIG. 2 is a view similar to FIG. 1, illustrating a preferred embodiment of the present invention.

FIG. 2 illustrates a dual line type matrix switching device embodying the present invention, the illustration being in cross section through one of the cross points of the matrix. The switching device includes a first plate of insulating material 201, and a second plate of similar material 202, which has spring supports 209 secured to the top surface thereof. Spring strips 206 are secured to the top of the spring supports 209 with movable contacts 205 welded to the bottom surface of each of the srping strips 206. As shown, the second insulating plate 202 is formed with through apertures to receive the respective movable contacts 205 therein. The top surface of the second insulating plate 202 is covered by a flanged cover 204 which is hermetically secured to the second insulating plate 202. The through apertures formed in the second insulating plate 202 are gastightly closed at the bottom end by the first insulating plate 201 to define a chamber sealed against the external atmosphere in cooperation with the flanged cover 204 and in which chamber the spring strips 206 and movable contacts 205 are accommodated. A pattern of metallized layer 208 is formed on the top surface of the first insulating plate 201 in closely adhering relation thereto and contact metal material is plated on the metalized layer 208 to form fixed contacts thereon at areas immediately below the through apertures formed in the second insulating plate 202.

Again in FIG. 2, reference numeral 203 indicates generally U-shaped iron cores (only one of which is shown) arranged on the underside of first insulating plate 201 with an energizing winding or coil 207 mounted on the central portion of each of the U-shaped cores 203 so that two paris of movable and fixed contacts are simultaneously closed and opened as the coil 207 is energized and de-energized. Obviously, the two pairs of contacts are assigned to the respective A and B lines of the two-wire type matrix switching device.

Figure 3:
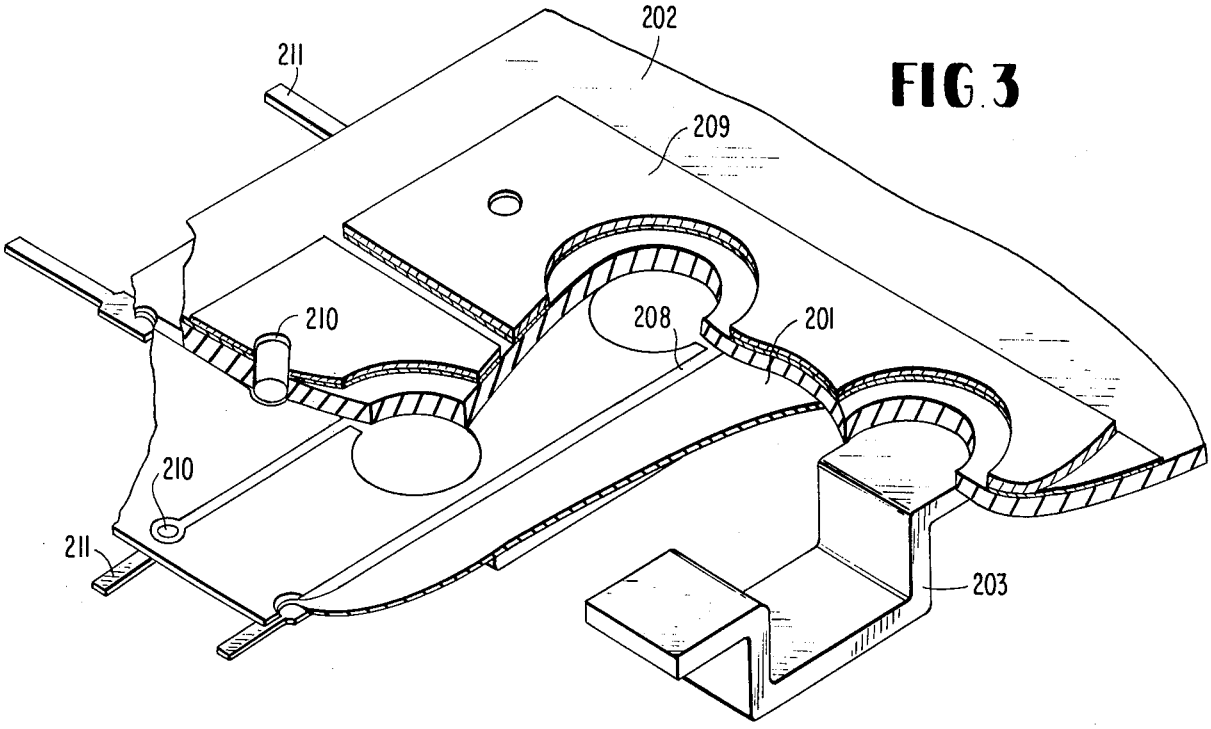
FIG. 3 is a fragmentary perspective view of a matrix switching device or substantially the same structure as that shown in FIG. 2.

FIG. 3 is a perspective view showing the construction of a two-wire type matrix switching device of substantially the same structure as that shown in FIG. 2. As illustrated, metallized layer 208, formed on the surface of the first insulating plate 201 in closely adhering relation thereto, are each plated with a contact metal material over portions thereof lying immediately below the through apertures formed in the second insulating plate 202 to form fixed contacts, the remaining portion of each of the metallized layer strips 208 serving as a signal line for the fixed contacts. Such signal lines are arranged as a pattern of conducting layer sandwiched between the first and second insulating plates 201 and 202 and connected to respective signal terminals 211 by way of through holes 210. On the other hand, signal lines for movable contacts 205 (FIG. 2) are each connected through the associated spring strip 206, spring support 209 and through hole 210 to the corresponding one of signal terminals 211. In the manner described, a matrix switching device can be constructed which includes any desired number of switch elements arranged on one and the same base plate consisting of a first and a second insulating plate with a pattern of conducting layer sandwiched therebetween.

Figure 4:
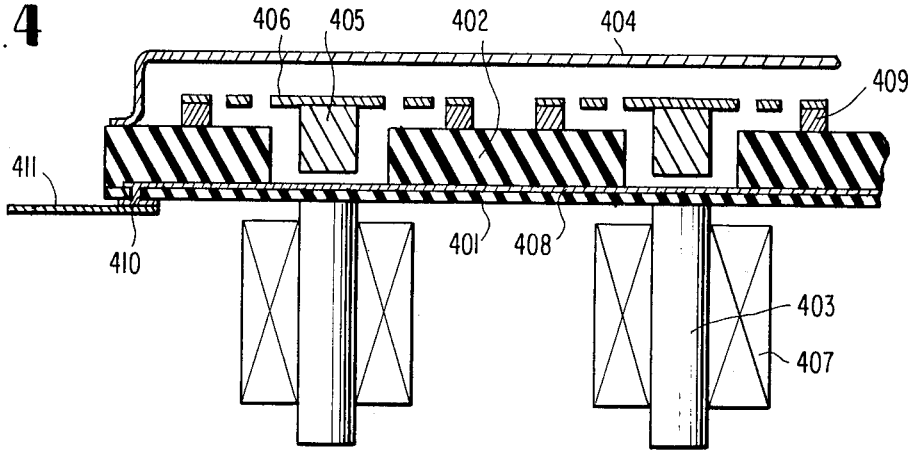
FIG. 4 is a fragmentary cross-sectional view illustrating a second preferred embodiment of the present invention.

Another form of matrix switching device embodying the present invention is illustrated in FIG. 4, in which an iron core 403 and an energizing winding or coil 407 are shown provided for each switch element. This embodiment is primarily intended for use as a single line type device but can also be used a two-wire type device by employing a single energizing winding for each pair of cores 403 in place of the two windings 407 shown fitted thereto. Reference numerals 401 and 402 indicate a first and a second insulating plate, respectively, of the switching device; 404 indicates a cover; 406, spring strips mounted on spring supports 409 and carrying movable contacts 405; 408, conductor means sandwiched between the two insulating plates 401 and 402; and 411, terminals connected to the conductor means by way of through holes 410.

Figure 5:
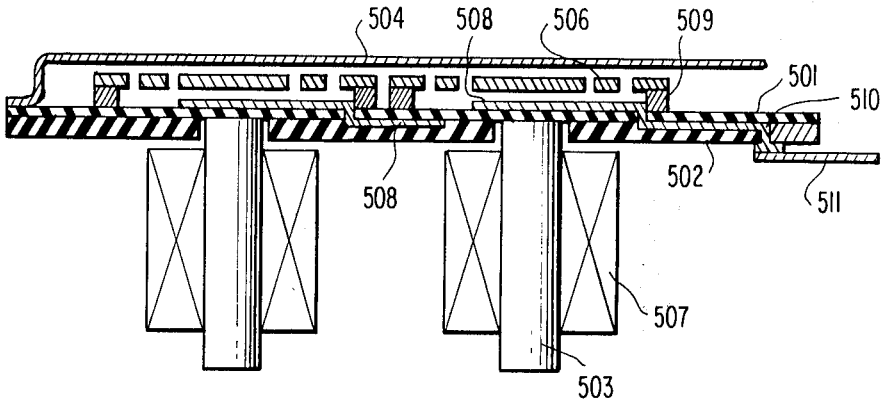
FIG. 5 is a view similar to FIG. 4, illustrating a third preferred embodiment of the invention.

FIG. 5 illustrates a further form of a matrix switching device embodying the present invention. In this embodiment, a first insulating plate 501 formed with fixed contacts on its top surface is placed on top of a second insulating plate 502 in closely adhering relation thereto with spring strips 506 supported on the first insulating plate 501 by means of spring supports 509. The spring strips 506 are formed of a magnetic material and plated with a contact metal material to form movable contacts thereon which cooperate with the respective fixed contacts formed on the first insulating plate 501. The second insulating plate 502 has apertures to receive iron cores 503, which are each fitted with an energizing coil 507. Reference numeral 504 indicates a cover member hermetically secured to the first insulating plate 501.

Upon energization of any of the cores 503, the movable contact portion of the associated spring strip 506 is attracted by the core 503 in an axial direction of the through aperture in which the core 503 is located and makes contact with the corresponding fixed contact which forms part of a metallized layer 508 coated on the first insulating plate 501. Such metallized layers 508 are connected to respective terminals 511 through respective through holes 510 formed in the first and second insulating plates and multiple wiring arrangement sandwiched therebetween for each line of the switch matrix. On the other hand, the movable contacts in each row of the matrix are multiply connected by means of spring strips 506 formed in common thereto so that as a whole a matrix switching device is formed.

Obviously, the size of such matrix switching device can be selected at will by varying the sizes of component parts such as the base plate and spring strips employed. Also, in the structure described above, spring supports 509 may be made as an integral part of the first insulating plate 501, if desired. Further, in cases where the insulating base pate is formed of ceramic material, it is practically feasible to bake the first and second insulating plates 501–502, spring supports 509, through holes 510 and metallized layers 508 all at the same time in the process of fabrication.

Figure 6:
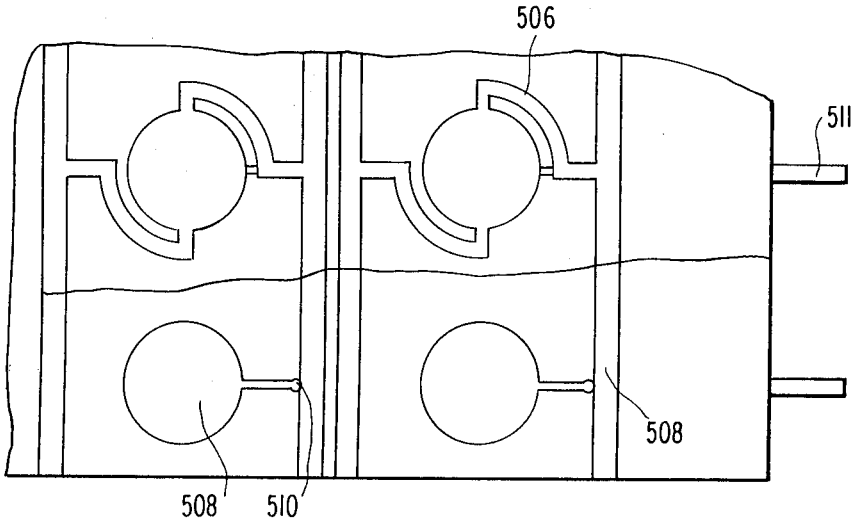
FIG. 6 is a fragmentary, partly cutaway plan view, illustrating a matrix switching device of substantially the same structure as that shown in FIG. 5.

Referring next to FIG. 6, which is a cutaway plan view showing a matrix switching device of substantially the same structure as that of FIG. 5, the fixed contact portions of metal film formation 508 are arranged immediately below the respective movable contact portions of spring strips 506 in spaced opposite relation thereto and connected through respective through holes 510 and the wiring arrangement between the first and second insulating plates to the terminals 511.

Figure 7:
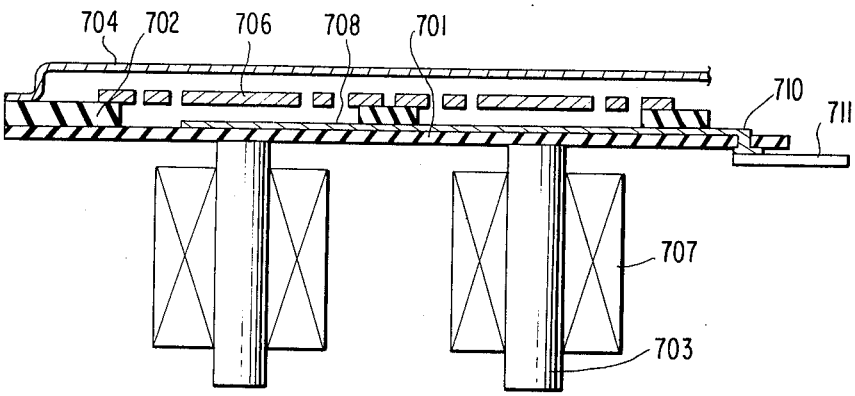
FIG. 7 is a cross-sectional view similar to FIGURES 4 and 5, illustrating a fourth preferred embodiment of the present invention.

FIG. 7 illustrates another form of matrix switching device embodying the present invention. As will be observed, in this embodiment, the second insulating plate 702, constituting a base plate in combination with the first insulating plate 701, is formed so as to serve also as a spring support common to spring strips 706. Reference numeral 704 indicates a cover hermetically secured to the second insulating plate 702; 708 indicates a metal film formation on the first insulating plate 701, which is connected to terminals 711 through respective through holes 710 formed in the first insulating plate 701; and 703 indicates core members fitted with respective energizing windings 707.

Figure 8:
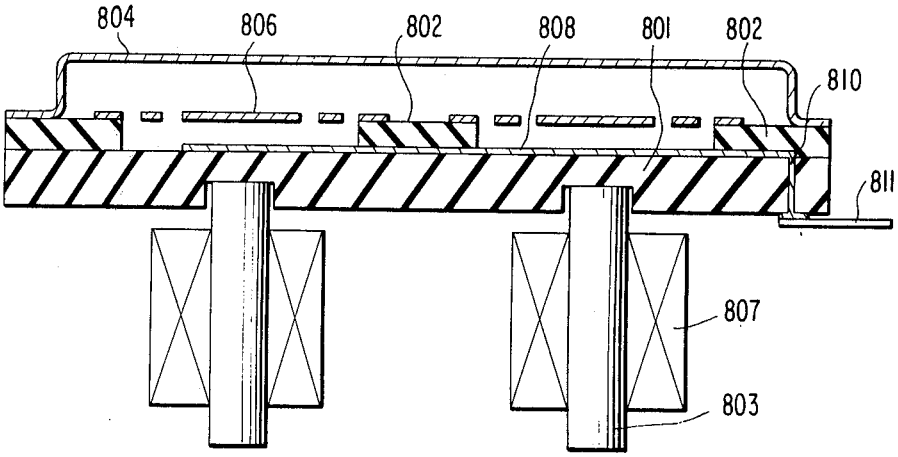
FIG. 8 is a cross-sectional view illustrating a fifth preferred embodiment of the present invention.

Another form of matrix switching device embodying the present invention is illustrated in FIG. 8 and includes, among others, a first insulating plate 801 grooved to receive core member 803 at locations corresponding to the switch elements of the device. The groove formation in the first insulating plate 801 makes it possible to make the first insulating plate 801 thick and high in mechanical strength without increasing the distance between the core members 803, on the one hand, and the spring strips 806, on the other hand, to any extent.

Through the embodiments shown and described herein are all so arranged that the movable contacts are driven for switching operation under the force of electromagnetic attraction of the respective core members, the integrated type switching device may be realized, if desired, in forms in which the movable contacts are driven in an electrical manner by providing the spring strips with appropriate electromechanical transducer elements such as electrets or piezoelectric elements and such modifications are within the contemplation of this invention. Further, though the illustrated embodiments are all of the structure including a sealing cover member (204, 404, etc.), it will be readily understood that such embodiments and their modifications can be used, as desired, in a state not sealed by any cover means with substantially the same successful results.

To summarize, the integrated type switching device of the present invention is principally of a structure comprising a base plate in the form of an integral combination of two insulating plates lying on each other, a patterned formation of fixed contacts on one of the insulating plates and movable contacts formed integral with spring strips suitably supported on the base plate and, as an integral unit including such component parts each formed in common to a plurality of switch elements, can advantageously be fabricated with increased efficiency and substantial reduction in size as well as in cost.

What is claimed is:

1. A switching device arranged in a matrix array comprising:

a first ceramic plate having a fixed contacts pattern of metalized layer arranged on one surface thereof;

second ceramic plate formed with through apertures in positions corresponding to said respective fixed contacts arranged on said first ceramic plate, said first and second ceramic plates being laid on each other in closely adhering relation to form an integral base plate for the switching device;

conductor means sandwiched between said first and second ceramic plates to connect to said fixed contacts with each other in each of the rows or columns of the matrix;

spring means carrying movable contacts made of a magnetic material and mounted on said base plate so that said movable contacts are positioned directly opposite to said respective fixed contacts for cooperation therewith;

a plurality of magnetic cores located adjacent said fixed contacts but on the opposite side of said first plate; and a plurality of energizing windings encircling said cores, said magnetic cores and windings being operable to selectively drive said movable contacts in an axial direction of said through apertures into contact with the corresponding fixed contacts.

2. A switching device as claimed in claim 1, wherein said magnetic cores are U-shaped with the ends of each core being adjacent two different fixed contacts so that two pairs of movable and fixed contacts are simultaneously closed and opened as the winding encircling that core is energized and de-energized.

3. A switching device as claimed in claim 1, further comprising a flanged cover hermetically secured to said integral base plate to form a sealed chamber containing said spring means and said movable contacts.

4. A switching device as claimed in claim 1, wherein said spring means comprises:

a plurality of spring supports mounted on said integral base plate about the peripheries of the through apertures in said second plate; and a plurality of spring strips mounted on said spring supports to suspend said movable contacts over said fixed contacts.

5. A switching device as claimed in claim 4, wherein said spring strips and said movable contacts are integral.

6. A switching device as claimed in claim 1, wherein said spring means are spring strips directly mounted to said second plate about the peripheries of said through apertures to suspend said movable contacts over said fixed contacts.

7. A switching device as claimed in claim 6, wherein said spring strips and said movable contacts are integral.

8. A switching device as claimed in claim 1, wherein said magnetic cores are located within the through apertures of said second plate.

9. A switching device as claimed in claim 1, wherein said first plate is provided with grooves in mechanical registry with said through apertures in said second plate and said drive means are located in said grooves.

* * * * *